United States Patent [19]

Cooper et al.

[11] Patent Number: 4,786,440

[45] Date of Patent: Nov. 22, 1988

[54] DETERGENT COMPOSITIONS USING AN AMINOCARBOXYLIC ACID AS BUILDER

[75] Inventors: Lance A. Cooper, Lake Jackson; Jaime Simon, Angleton; David A. Wilson, Richwood, all of Tex.

[73] Assignee: The Dow Chemical Company, Midland, Mich.

[21] Appl. No.: 752,707

[22] Filed: Jul. 8, 1985

[51] Int. Cl.[4] ..... C11D 3/30

[52] U.S. Cl. ..... 252/546; 252/135; 252/174.18; 252/174.21; 252/527; 252/528; 252/540; 252/547; 252/559; 252/DIG. 11

[58] Field of Search ..... 252/527, 546, DIG. 11; 562/565

[56] References Cited

U.S. PATENT DOCUMENTS

| | | | |
|---|---|---|---|
| 3,580,950 | 5/1971 | Bersworth | 562/565 |
| 3,832,309 | 8/1974 | Foster et al. | 252/DIG. 11 |
| 4,020,016 | 4/1977 | Sokol | 252/DIG. 11 |
| 4,443,355 | 4/1984 | Murata et al. | 252/174.12 |

*Primary Examiner*—Paul Lieberman
*Assistant Examiner*—Hoa Van Le
*Attorney, Agent, or Firm*—A. Cooper Ancona

[57] ABSTRACT

Triethylenetetraminehexaacetic acid is used as a builder in combination with a surfactant or mixture of surfactants to provide a detergent composition having excellent properties. In the series of ethyleneaminopolycarboxylic acids triethylenetetraminehexaacetic acid was found unexpectedly superior as a substitute for nitrilotriacetic acid as a builder in detergent formulations.

31 Claims, No Drawings

DETERGENT COMPOSITIONS USING AN AMINOCARBOXYLIC ACID AS BUILDER

BACKGROUND OF THE INVENTION

This invention relates to detergent formulations employing a particular aminocarboxylic acid as a builder component.

The use of builders as additives to soap and synthetic surfactants, and the property which some materials have of improving detergency levels of such detergent formulations are well known phenomena. The phenomena are widely appreciated but the exact behavior and mechanics of how builders perform their function have never been fully explained. While many explanations for the behavior of builders may be found, there still has not been determined a set of criteria which would permit one to accurately predict which compounds actually possess builder properties.

In view of the many factors which contribute to improving the cleaning power of surfactants, and in view of the most recent art in this field, it is necessary for a builder to meet certain requirements, including the ability to:

(1) sequester the hardness-inducing agents of the water, such as calcium and magnesium ions;

(2) disperse pigment dirt particles, which are the principal constituents of the dirt of fabrics, in the wash-bath;

(3) stabilize the dirt removed in the wash-bath and prevent dirt particles from redepositing on the fiber;

(4) inactivate mineral matter being contained in the wash-bath; and (5) reduce the precipitation of surfactants.

The two most commonly employed types of surfactants are anionic and nonionic. The former can be broadly described as the water-soluble salts, particularly the alkali metal salts of organic sulfuric reaction products having in their molecular structure an alkyl radical containing from about 8 to about 22 carbon atoms and a radical selected from the group consisting of sulfonic acid and sulfuric acid ester radicals. Included in the term alkyl is the alkyl portion of higher acyl radicals. Important examples of such surfactants are the sodium alkyl sulfates, especially those obtained by sulfating the higher alcohols ($C_3$–$C_{13}$ carbon atoms) produced by reducing the glycerides of tallow or coconut oil; sodium or potassium alkylbenzenesulfonates, in which the alkyl group contains from about 9 to about 15 carbon atoms, sodium alkylglycerylethersulfonates, especially those ethers of the higher alcohols derived from tallow and coconut oil; sodium coconut oil fatty acid monoglyceride sulfates and sulfonates; sodium or potassium salts of sulfuric acid esters of the reaction product of one mole of a higher fatty alcohol (e.g., tallow or coconut oil alcohols) and about 1 to 6 moles of ethylene oxide; sodium or potassium salts of alkylphenol ethylene oxide ether sulfate with about 1 to about 10 units of ethylene oxide per molecule and in which the alkyl radicals contain about 9 to about 12 carbon atoms; the reaction product of fatty acids esterified with isethionic acid and neutralized with sodium hydroxide, where, for example, the fatty acids are derived from coconut oil; sodium or potassium salts of fatty acid amide of a methyltauride in which the fatty acids, for example, are derived from coconut oil.

Nonionic surfactants may be broadly defined as compounds aliphatic or alkyl aromatic in nature which do not ionize in water solution.

For example, a well known class of nonionic synthetic detergents is available on the market under the trade name of "Tergitol"*. These compounds are formed by condensing ethylene oxide, alternatively propylene oxide, with an alcohol. The hydrophobic portion of the molecule which exhibits water insolubility has a total carbon chain length of from about 8 to about 20 carbon atoms. The addition of polyoxyethylene radicals to the hydrophobic portion tends to increase the water solubility of the molecule as a whole. The method of making such surfactants is well known to the art, comprising reacting the alkylene oxide and the long chain alcohol together in the presence of an acid catalyst, e.g. $BF_3$.

*Trademark of Union Carbide Corporation

Other suitable nonionic surfactants include:

(1) The polyethylene oxide condensates of alkylphenols, e.g., the condensation products of alkylphenols or dialkylphenols wherein the alkyl group contains from about 6 to 12 carbon atoms in either a straight chain or branched chain configuration, with ethylene oxide, the ethylene oxide being present in amounts equal to about 3 to 25 moles of ethylene oxide per mole of alkylphenol.

(2) The condensation product of aliphatic alcohols having from 8 to 18 carbon atoms, in either straight chain or branched chain configuration, with ethylene oxide, e.g., a coconut alcohol-ethylene oxide condensate having from about 3 to 30 moles of ethylene oxide per mole of coconut alcohol, the coconut alcohol fraction having from 10 to 14 carbon atoms.

(3) Long chain tertiary amine oxides corresponding to the following general formula, $R_1R_2R_3N \rightarrow O$, * wherein $R_1$ is an alkyl radical of from about 8 to 18 carbon atoms, and $R_2$ and $R_3$ are each methyl or ethyl radicals. Examples of amine oxides suitable for use in this invention include dimethyldodecylamine oxide, dimethyloctylamine oxide, dimethyldecylamine oxide, dimethyltetradecylamine oxide, dimethylhexadecylamine oxide.

(4) Long chain tertiary phosphine oxides corresponding to the following general formula $RR'R''P \rightarrow O$ wherein R is an alkyl, alkenyl or monohydroxyalkyl radical ranging from 10 to 18 carbon atoms in chain length and R' and R'' are each alkyl or monohydroxyalkyl groups containing from 1 to 3 carbon atoms. Specific examples can be found in U.S. Pat. No. 3,159,581.

*The arrow in the formula is a conventional representation of a semipolar bond.

Builders are formulated with such surfactants to enhance their cleaning capabilities. Among the builder materials described in the prior art, are water-soluble inorganic alkaline builder salts which are used alone or in combination. Examples are alkali metal carbonates, borates, phosphates, polyphosphates, bicarbonates and silicates.

Various organic compounds have already been suggested for use as builders, e.g. nitrilotriacetic acid (NTA), ethylenediaminetetracetic acid (EDTA), citric acid, oxydiacetic acid, oxydisuccinic acid, and polymeric carboxylic acids. Additional builders are indicated in U.S. Pat. No. 4,265,776.

As previously noted, NTA is recognized as an efficient detergent builder. Unfortunately, initial toxicity studies (performed when NTA was just beginning to be seriously considered as a detergent builder replacement for phosphates) linked NTA to cancer. This resulted in a voluntary ban on use of NTA in detergents by major detergent manufacturers. The search for an efficient non-phosphorus containing builder thus continues. Naturally other lower molecular weight aminopolycarboxylic acids were tested, such as EDTA and diethylenetriaminepentaacetic acid (DTPA).* However, their performance was less than satisfactory. As a result of these tests it has been generally assumed that as the molecular weight of the polyaminocarboxylic acid increased, the building efficency decreased.

*Methods of making these carboxylic acid derivatives of amines are found in *Chelating Agents and Metal Chelates*, Ed. Dwyer, F. P. and Mellor, D. P., Academic Press, New York, N.Y. (1964), pp. 285–288.

It has now been found that, unexpectedly, triethylenetetraminehexaacetic acid (TTHA) is superior to both the EDTA, DTPA and the next higher member of the series, which is tetraethylenepentaminheptaacetic acid (TPHA).

SUMMARY OF THE INVENTION

Triethylenetetraminehexaacetic acid, when employed as a builder with surfactants, is unexpectedly superior to other members of the series of ethyleneaminopolycarboxylic acids both above and below it in molecular weight.

DETAILED DESCRIPTION OF THE INVENTION

While the lower molecular weight ethyleneaminopolycarboxylic acids, e.g. EDTA and DTPA, have been employed as builders in detergent formulations, the expectation was that as the molecular weight increased, the efficiency decreased. It was unexpected that the TTHA would perform substantially better than either the lower or higher molecular weight ethyleneaminopolycarboxylic acids in the series. While not quite as efficient a builder as the NTA, it is much better than any other polyaminocarboxylic acid of the ethyleneamine series.

Amounts of surfactant employed in a wash will depend upon the particular one employed, but generally the amount is within the range of from about 30 to about 3500 ppm (parts per million) by weight based on the water, the preferred range being from about 60 to about 300 ppm.

When the builder of the present invention is used in combination with the surfactant, the ratio of builder to surfactant is from about 76:1 to about 1:6. A preferred ratio is from about 23:1 to about 6:1.

Additionally TTHA may be used as a co-builder in any formulation in the above-stated forms, i.e. liquid, powder, tablet, etc. For example, a reduced phosphorus formulation in which a portion of the sodium tripolyphosphate (STPP) is replaced by TTHA to produce an efficient effective cleaning formulation which might be employed in areas imposing phosphorus content restrictions upon detergent formulations. The following are representative examples of additional co-builders for TTHA: citrates, polyacrylates, laurates, zeolites, polyitaconic acid, phosphonates, carboxymethyl succinate and the like.

TESTING PROCEDURE

Swatches*, measuring ~3"×4", of two different materials, (1) #405 cotton and (2) #7406 blend of dacron 54/cotton (65/35), durable press finish, were tested in the Terg-o-tometer** using various detergent formulations. Swatches were washed in 1.0 liter of 150 ppm hardness water ($CaCO_3$ with $Ca^{++}/Mg^{++}=2.0$) at a temperature of 120° F. The agitation rate was 100 rpm and cycle time was 10 minutes. The detergent formulations tested were added in two parts, (a) the detergent solution and (b) the builder solution.

(a) The surfactant solution consisted of 3.0 g of Tergitol*** 25-L-5 and 20 g of a 40% solution of sodium xylene sulfonate diluted with water to a final volume of 250 ml. Five ml of the surfactant solution was added to each washing vessel resulting in a working surfactant concentration of 60 mg surfactant per liter.

(b) Builders were added to the surfactant solution just prior to swatch addition to the wash solution. All builders were solutions of between 5–40% active builder by weight which had been previously adjusted to pH of approximately 11.0 using NaOH. In order to better control pH throughout the wash cycle and minimize pH buffering differences between various builders, 25% or 250 ml of the wash solution was composed of a pH 10.0 buffer solution containing borax and NaOH (see *Lange's Handbook of Chemistry*, 12th ed., 1979, Section 5, page 78). Builder concentrations were varied for the different experiments.

*Cloth swatches were obtained from Testfabrics Inc., Middlesex, New Jersey.

**Terg-o-tometer, Model 7243, manufactured by United States Testing Company, Inc.

***Trademark for a nonionic surfactant, an ethoxylated alcohol, manufactured by Union Carbide Corporation.

Two varieties of soil were used, (1) simulated sebum with ground-in clay and (2) used motor oil with ground-in clay. Thus, each load contained two cotton swatches and two cotton/polyester swatches (described above), one of each with each soil type.

The extent of cleaning was determined by measuring the reflectance of each swatch before and after washing and adding the four individual values (one for each swatch) to yield a number designated as total detergency. Therefore, the higher the total detergency number, the greater the extent of soil removal. All reflectance measurements were made using a Hunterlab model D-40 reflectometer, utilizing the blue filter.

In summary: Soiled swatches were analyzed for initial reflectance. Wash solution was prepared (containing 250 ml pH 10.0 buffer, 750 ml $H_2O$ and sufficient hardness to make the solution 150 ppm hardness as $CaCO_3$). The builder and surfactant were added to the wash solution followed by the swatches and the swatches washed for ten minutes. The swatches were removed at the end of the wash cycle, rinsed in cold tap water, and dried. The reflectance of the washed swatches was then recorded and total detergency calculated.

In the following examples the sodium salt of TTHA was added to detergent compositions and compared against substantially identical detergent compositions utilizing sodium salts of other builders.

EXAMPLE A (COMPARATIVE)

Test solutions were employed in which the concentration of the nonionic surfactant (Tergitol* 25-L-5) was identical in each at 60 ppm. The builder, in this case NTA, was varied in concentration to determine the effect of NTA concentration upon the total detergency. NTA concentrations of 413ppm and 550 ppm were used. The reflectance of the swatches was measured before and after washing and the total detergency values calculated. Results shown in Table I indicate that the detergency increases with increasing builder concentration. These results are typical for this, and other known effective builders.

EXAMPLE B (COMPARATIVE)

The same tests were conducted as in Example A using the sodium salt of the next higher polyaminocarboxylic acid analogue EDTA, in place of NTA. Again, surfactant concentration (Tergitol* 25-L-5) was held constant at 60 ppm while the EDTA concentration was varied, using concentrations of 413 ppm, and 550 ppm again. The results, shown in Table I, again show a trend of increasing detergency with increasing builder concentration except in this case the values of total detergency are much less than with the more efficient builder, NTA. This demonstrates the much lower efficiency of EDTA as a builder compared with NTA.

*Trademark of Union Carbide Corporation

EXAMPLE C (COMPARATIVE)

The tests of Example A were again conducted, this time using the next higher polyaminocarboxylic acid analogue, the sodium salt of DTPA, as the builder. The identical tests were conducted with the same surfactant and builder concentrations. Results of these tests are shown in Table I.

EXAMPLE 1

The sodium salt of TTHA was substituted as the builder in the identical procedure of Example A. The results are shown in Table I. A surprising improvement in total detergency was observed at 550 ppm. The observed value, 98.2, was a substantial and unexpected improvement over the lower polyaminocarboxylic acid analogues, EDTA and DTPA. TTHA is still not quite as efficient a builder as NTA but is substantially and unexpectedly more efficient than would have been expected based on the observed trend in total detergency achieved with the second and third polyaminocarboxylic analogues.

The next higher analogue in the series, TPHA, was employed in another comparative example.

EXAMPLE D (COMPARATIVE)

Additional tests were conducted using the same conditions as used previously except that TPHA was substituted as the builder. The results are shown in Table I.

TABLE I

| | Total* Detergency | | | | |
|---|---|---|---|---|---|
| Ppm | (A) NTA | (B) EDTA | (C) DTPA | (D) TPHA | (1) TTHA |
| 413 | 109 | 30.8 | 27.1 | — | 50.3 |
| 550 | 136 | 48.1 | 46.9 | 45.6 | 98.2 |

EXAMPLE 2 AND COMPARATIVE EXAMPLES E, F AND G

Another series of experiments was conducted in which an anionic surfactant was substituted for the nonionic one of Example 1 and the comparative Examples A, B, C and D.

The builders were employed at 550 ppm, the surfactant, Bio Soft D-40**, was added at 120 ppm. The test was conducted at 120° F. (49° C.) in water of 150 ppm (as $CaCO_3$) hardness. Results are shown in Table II.

TABLE II

| | Total Detergency | | |
|---|---|---|---|
| (E) NTA | (F) DTPA | (G) TPHA | (2) TTHA |
| 86.1 | 32.2 | 26.2 | 48.5 |

It should be noted that the anionic surfactant did not perform as well as the nonionic surfactant but the same unexpected result with TTHA was observed.

*Sum of reflectance before washing minus reflectance after washing using four soiled swatches.

**Trade name of an anionic surfactant (sodium dodecylbenzenesulfonate) available from Stepan Chemical Company.

The detergent formulations incorporating the polyaminocarboxylic acid of the invention, i.e. TTHA, can be employed in a final detergent product of any form—liquid, powder, paste, flake, pellet, tablet, emulsion, suspension, aerosol and the like. The formulation may also include besides a surfactant and builder other additives such as anti-corrosives, anti-redeposition agents and brighteners.

It should be understood that while the examples show the use of a single detergent with a single builder, combinations of two or more detergents can also be employed with the builder of the present invention. Also, other builders can be used in combination with the builder of this invention, i.e. triethylenetetraminehexaacetic acid. Thus, $Na_2CO_3$ and TTHA, or NTA and TTHA can be employed together. Mixtures of the various surfactants are commonly used in detergent formulations and such mixtures can have several builders included.

The known surfactants and builders as described in the "Background" are all useful in combination with the builder of the present invention.

We claim:

1. A detergent composition comprising a surfactant and a builder wherein the builder is triethylenetetraminehexaacetic acid or a water soluble salt thereof.

2. The composition of claim 1 wherein the surfactant is an anionic, a nonionic or a cationic surfactant, or a mixture thereof.

3. The composition of claim 2 wherein the surfactant is a nonionic surfactant.

4. The composition of claim 3 wherein the nonionic surfactant is the condensation product of an alkylene oxide with an aliphatic alcohol having from about 8 to about 20 carbon atoms.

5. The composition of claim 4 wherein the alkylene oxide is ethylene or propylene oxide or a mixture thereof.

6. The composition of claim 4 wherein the alkylene oxide chain comprises up to about 95 weight percent of the condensed product.

7. The composition of claim 5 wherein the alkylene oxide chain comprises up to about 95 weight percent of the condensed product.

8. The composition of claim 2 wherein the surfactant is an anionic surfactant.

9. The composition of claim 1 wherein the builder is in the form of its sodium salt.

10. The composition of claim 2 which contains one or more builders in addition to the triethylenetetraminehexaacetic acid or a water soluble salt thereof.

11. The composition of claim 10 wherein the added builder is an alkali metal carbonate, bicarbonate, borate, phosphate, polyphosphate, silicate or mixtures thereof.

12. The composition of claim 10 wherein the added builder is an organic carboxylic acid or an alkali metal salt thereof.

13. The composition of claim 12 wherein the organic carboxylic acid is citric, oxydiacetic, oxydisuccinic, lauric, polyacrylic, polyitaconic, carboxymethylsuccinic acid or mixtures thereof.

14. The composition of claim 12 wherein the builder is nitrilotriacetic acid or a water soluble salt thereof.

15. The composition of claim 3 which contains one or more builders in addition to the triethylenetetraminehexaacetic acid or a water soluble salt thereof.

16. The composition of claim 15 wherein the added builder is an alkali metal carbonate, bicarbonate, borate, phosphate, polyphosphate, silicate or mixtures thereof.

17. The composition of claim 15 wherein the added builder is an organic carboxylic acid or an alkali metal salt thereof.

18. The composition of claim 17 wherein the organic carboxylic acid is citric, oxydiacetic, oxydisuccinic, lauric, polyacrylic, polyitaconic, carboxymethylsuccinic acid or mixtures thereof.

19. The composition of claim 17 wherein the builder is nitrilotriacetic acid or a water soluble salt thereof.

20. The composition of claim 8 which contains one or more builders in addition to the triethylenetetraminehexaacetic acid or a water soluble salt thereof.

21. The composition of claim 20 wherein the added builder is an alkali metal carbonate, bicarbonate, borate, phosphate, polyphosphate, silicate or mixtures thereof.

22. The composition of claim 20 wherein the added builder is an organic carboxylic acid or an alkali metal salt thereof.

23. The composition of claim 22 wherein the organic carboxylic acid is citric, oxydiacetic, oxydisuccinic, lauric, polyacrylic, polyitaconic, carboxymethylsuccinic acid or mixtures thereof.

24. The composition of claim 22 wherein the builder is nitrilotriacetic acid or a water soluble salt thereof.

25. The composition of claim 2 wherein the builder is in the form of its sodium salt.

26. The composition of claim 3 wherein the builder is in the form of its sodium salt.

27. The composition of claim 8 wherein the builder is in the form of its sodium salt.

28. In a method of washing clothes by adding a detergent to the wash water, the improvement which comprises using as the detergent a composition containing a surfactant and triethylenetetraminehexaacetic acid or a water soluble salt thereof.

29. The method of claim 28 wherein the surfactant is a nonionic, a cationic or an anionic surfactant, or a mixture thereof.

30. The method of claim 29 wherein the triethylenetetraminehexaacetic acid is in the salt form.

31. The method of claim 30 wherein the salt is the sodium salt.

* * * * *